US006372976B2

(12) United States Patent
Damm

(10) Patent No.: US 6,372,976 B2
(45) **Date of Patent: *Apr. 16, 2002**

(54) SINGLE-COIL ELECTRIC GUITAR PICKUP WITH HUMBUCKING-SIZED HOUSING

(75) Inventor: Wolfgang Damm, Marburg-Moischt (DE)

(73) Assignee: Gibson Guitar Corp., Nashville, TN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/173,605

(22) Filed: Oct. 16, 1998

Related U.S. Application Data

(63) Continuation of application No. 08/740,018, filed on Oct. 23, 1996, now Pat. No. 5,894,101.

(30) Foreign Application Priority Data

Oct. 25, 1995 (DE) ..... 295 16 827 U

(51) Int. Cl.[7] ..... G10H 3/00
(52) U.S. Cl. ..... 84/723; 84/725; 84/727

(58) Field of Search ..... 84/291, 723, 725–728, 84/DIG. 24

(56) References Cited

U.S. PATENT DOCUMENTS

| | | | | | |
|---|---|---|---|---|---|
| 3,711,619 | A | * | 1/1973 | Jones et al. | 84/1.15 |
| 4,524,667 | A | * | 6/1985 | Duncan | 84/1.15 |
| 4,854,210 | A | * | 8/1989 | Palazzolo | 84/1.15 |
| 4,872,386 | A | * | 10/1989 | Betticare | 84/726 |
| 5,252,777 | A | * | 10/1993 | Allen | 84/726 |

OTHER PUBLICATIONS

Vintage Guitar.com magazine article entitled "Gibson ES–357" (undated but admitted to describe prior art).

Exhibit A Aug. 10, 2000 letter describing Harmonic Design Pickup.

* cited by examiner

*Primary Examiner*—Marlon T. Fletcher
(74) *Attorney, Agent, or Firm*—Waddey & Patterson; Lucian Wayne Beavers

(57) ABSTRACT

A pickup for an electric guitar includes a housing made to fill an existing cavity in an electric guitar body originally used for a dual-coil humbucking pickup. The pickup also has a single pickup coil mounted in the housing.

24 Claims, 8 Drawing Sheets

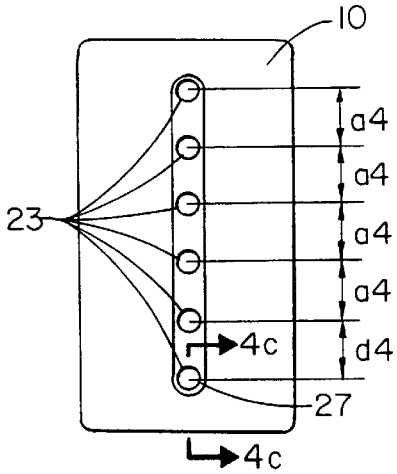
FIG. 4a
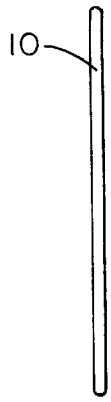
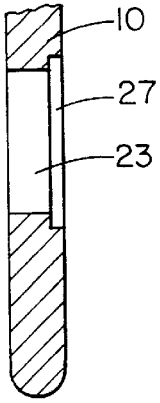
FIG. 4c
FIG. 4b
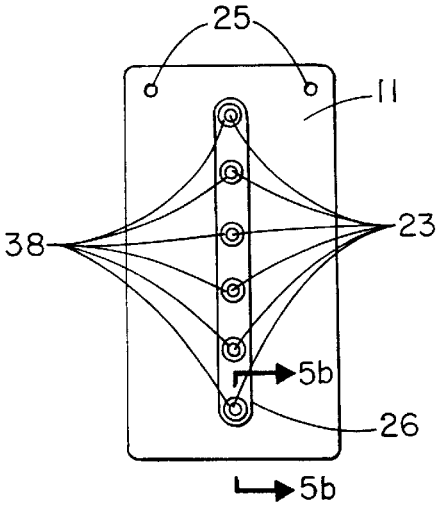
FIG. 5a
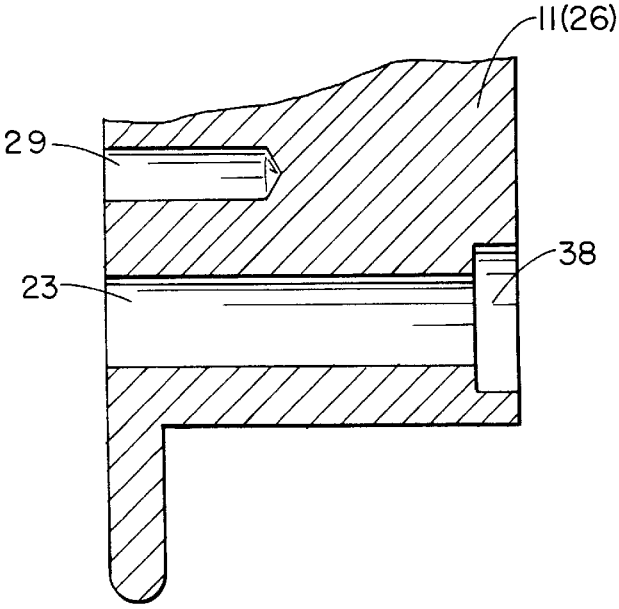
FIG. 5b 10
23

10
23

24
10

10
23
23

10
23

17

SINGLE-COIL ELECTRIC GUITAR PICKUP WITH HUMBUCKING-SIZED HOUSING

This application is a continuation of application Ser. No. 08/740,018, filed Oct. 23, 1996, now U.S. Pat. No. 5,894, 101.

RELATED CASE

The present application claims priority from the application which was filed Oct. 25, 1995 and registered Feb. 1, 1996 as German Utility Model Registration No. 295 16 827.7, which is incorporated herein by reference for all purposes.

BACKGROUND OF THE INVENTION

This invention relates generally to electric guitar pickups and more particularly to such pickups that have a single coil.

As a rule there are two kinds of pickups for guitars: single-coil and compound coil pickups. Usually the different types of pickups have characteristic and therefore different designs which have established themselves as standard in the guitar industry.

The single-coil pickup typically not only transfers a response to the oscillation of the strings but also undesirable interferences such as those from transformers, which results in a humming noise. The compound coil pickup known as a humbucking pickup (see FIG. 7) eliminates external hum interference by using two parallel coils with opposite winding directions and magnetization.

The invention of the compound, humbucking coil pickup has made it possible to suppress hum interference. However, this system of parallel coil design (vertical or horizontal) may be disadvantageous in that in addition to suppressing humming noise, desirable signals can be suppressed and sound volume lost.

In some instances, a guitar player may want the hum-suppressed tonality of a humbucking pickup, but at another time the guitar player may want the tonality of a single-coil pickup. One way to accommodate this is to physically change out the humbucking pickup for the single-coil pickup. To do this has required:

a) modifications to the instrument (drilling and milling work) or b) optical/aesthetic deficiencies on the instrument because the different types of pickups have not been interchangeable due to their different structures. There is thus the need for an improved single-coil pickup that can directly replace a humbucking pickup without having these shortcomings.

SUMMARY OF THE INVENTION

The present invention overcomes the above-noted and other shortcomings of the prior art by providing a novel and improved single-coil pickup for an electric guitar previously adapted for a compound-coil humbucking pickup.

It is an object of the invention to provide a single-coil pickup with its differentiated acoustic pattern, in the format of a typical humbucking coil of the type shown in FIG. 7 to facilitate exchanging one with the other.

Easy exchangeability means that no modification such as drilling or milling is necessary on the instrument and that after the exchange is carried out, the optical and aesthetic integrity of the instrument is whole again and that there are no gaps or slots which make the inside of the instrument visible.

There also is an active collector's market for guitars and the resell value of an instrument, among other things, depends strongly on its "original state". This is another reason why it is important that it be possible to get the original appearance back after a pickup replacement is completed, which is easy to do with the newly developed pickup.

Accordingly, the present invention broadly provides a pickup for an electric guitar, which pickup comprises: housing means for filling an existing cavity defined in an electric guitar body to receive a humbucking pickup; and a single pickup coil mounted in the housing means.

The present invention more specifically provides a pickup for an electric guitar, which pickup comprises a base plate having a length and a width commensurate with the length and width of a humbucking pickup. This base plate includes a bottom wall having a plurality of holes defined therein equal in number to the number of strings of the electric guitar, the bottom wall further having two openings and an aperture defined therein; and the base plate also includes two side walls extending along opposite side edges of the bottom wall. The overall pickup further comprises: two magnets disposed along the bottom wall on opposite sides of the plurality of holes; a coil form disposed on the magnets, the coil form having a plurality of channels defined therethrough with the plurality of channels aligned with the plurality of holes; a plurality of pole pieces, each of the pole pieces disposed in a respective one of the channels and the respective aligned one of the holes; a single pickup coil mounted on the coil form; a housing cover disposed around the coil form; and two screws, each of the screws disposed through a respective one of the openings of the bottom wall of the base plate and engaging the coil form.

Therefore, from the foregoing, it is a general object of the present invention to provide a novel and improved single-coil electric guitar pickup with a humbucking-sized housing. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 4*a* is a bottom view of a top plate of the two-piece coil form.

FIG. 4*b* is an edge view of the top plate.

FIG. 4*c* is a partial sectional view taken along line 4*c*—4*c* in FIG. 4*a*.

FIG. 5*a* is a top view of a bottom part of the coil form.

FIG. 5*b* is a partial sectional view taken along line 5*b*—5*b* in FIG. 5*a*.

DETAILED DESCRIPTION OF PREFERRED EMBODIMENTS

The improvement of the present invention, namely the pickup thereof, includes a housing having a size for a humbucking pickup so that the housing fits fully into an existing cavity or other predefined location of an electric guitar body without modifying such location, other than to remove a prior pickup if still located there. The housing of the preferred embodiment includes a base plate from which one or more flanges extend to connect the pickup to a mounting frame. The present invention further comprises a single pickup coil, a coil form, magnetic elements, a housing cap and a connector cable associated with the housing. These elements will be further described in the following sections with reference to the drawings.

Coil Form

Instead of using two side-by-side (horizontal) coil forms as is customary for a humbucking format (see FIG. 7), the present invention preferably only uses one coil form (FIG. 3*a*) which is located in longitudinal direction (preferably axially symmetrical) (FIGS. 1 and 2); however, it is also possible to use two or more coil forms. It is possible to position the coil form(s) off center (see FIGS. 8*b*, 8*d* and 8*e*, for example) and to turn the coil form(s) by preferably 90° around their longitudinal axis in all positions mentioned above.

Figure 3A:
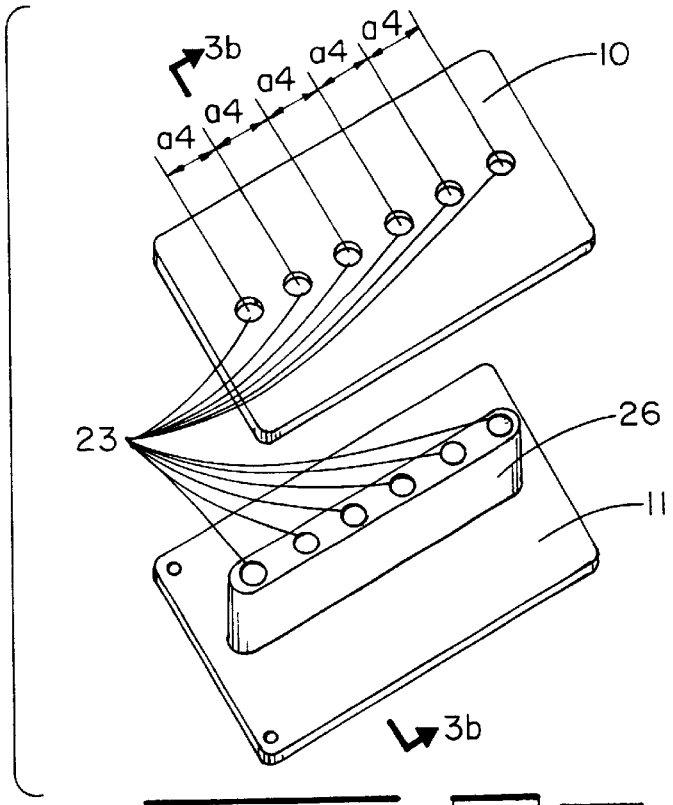
FIG. 3*a* is an exploded view of a two-piece coil form of the preferred embodiment.
Figure 3B:
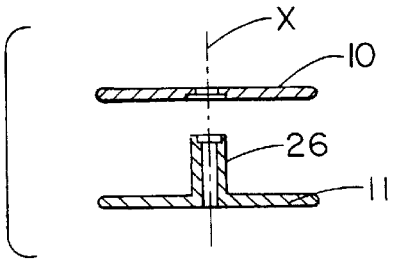
FIG. 3*b* is a cross-sectional view taken along line 3*b*—3*b* in FIG. 3*a*.

The coil form itself preferably is comprised of two parts 10, 11 (one part also possible) so that it is possible to combine different materials, surfaces, surface structures and colors on the surface of upper member 10 (FIGS. 3*a*–3*c*), which is visible from the surface of the instrument when an open top cap is used as described below.

The two coil form parts preferably are positioned by means of a cavity 27 of longitudinal and axially symmetrical direction (FIGS. 3*c* and 4) in the upper plate 10 in which the lower coil form part 11 has an exact fit. A ridge 26 (FIGS. 3*a* and 5*a*) of the lower coil form part 11 has a positive and exact fit in the cavity 27 on the lower side of the upper part of the coil form 10. This can also be accomplished with pins and corresponding holes (not shown). The frictional connection of the structure preferably is enhanced by gluing or welding the two parts.

Two cable bushings or voids 25 (FIG. 5*a*) preferably are located in the outer area of a lateral side of the lower part 11 of the coil form.

Figure 7:
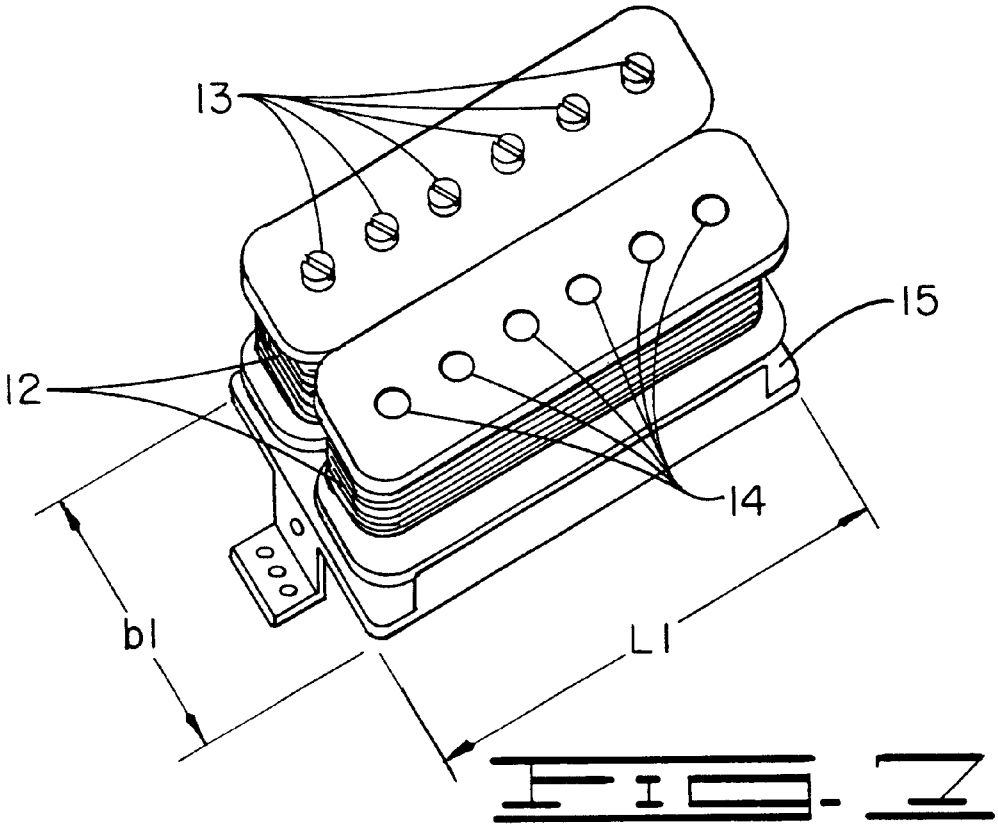
FIG. 7 is a perspective drawing of a typical humbucking compound coil pickup of the prior art showing dimensions to which those of FIG. 6 have been correlated.
Figures 8A, 8B, 8C, 8D, 8E, 8F:
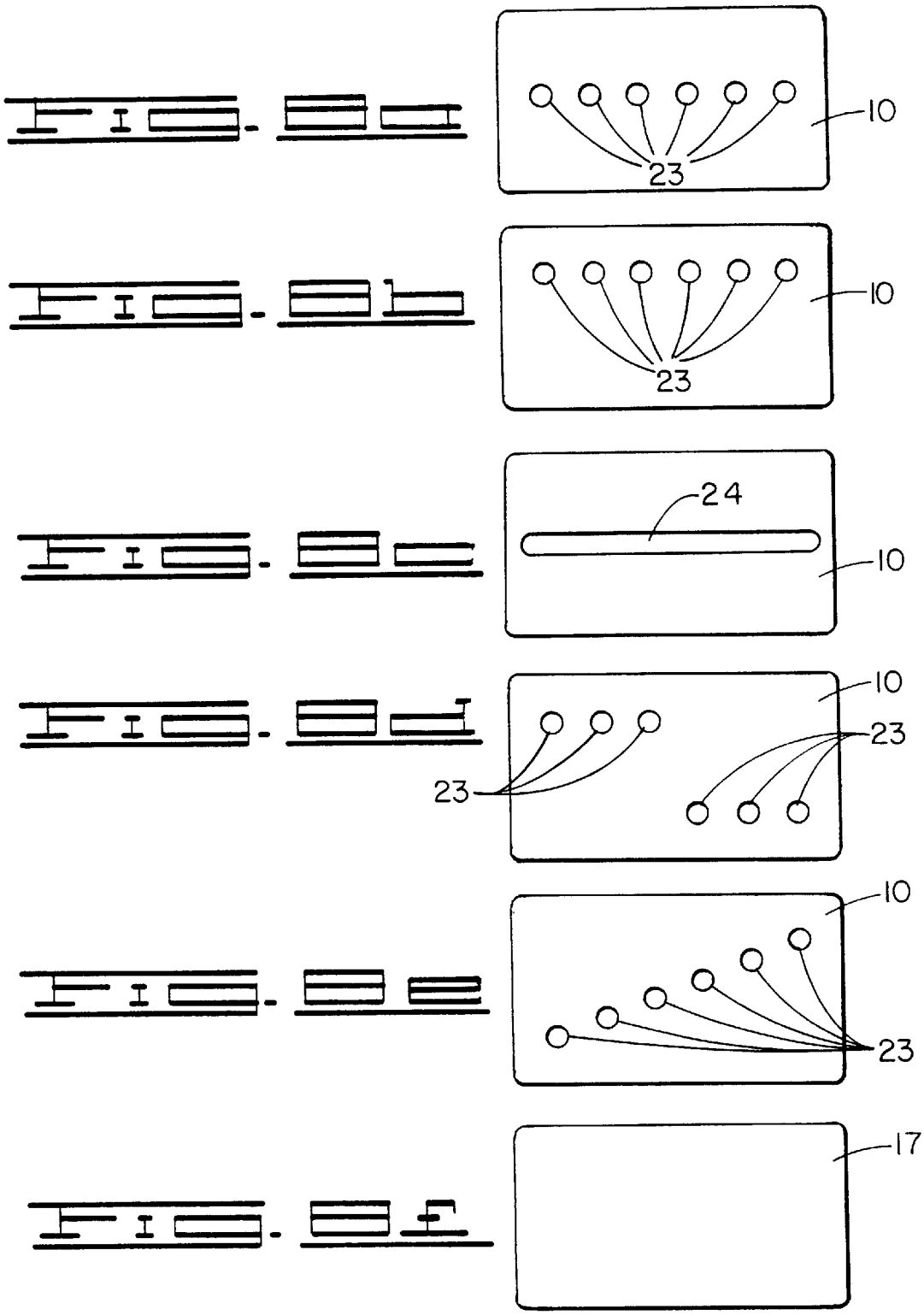
FIGS. 8*a*–8*e* are schematic top views of examples of various forms of the coil form top plate.
FIG. 8*f* shows the top of a closed top cap for a housing of the present invention.

Six bores or channels 23 (FIGS. 3*a* and 5*a*) for preferably screw-on terminals or pole pieces 13 (FIG. 2) preferably are located in longitudinal and axially symmetrical direction. Other positions for the screw-on terminals, even as pole blades, are possible. Examples are shown in FIGS. 8*a*–8*e* (FIG. 8*c* shows a slot 24 for receiving a pole blade). FIG. 7 shows other pole pieces 14 in a conventional two-coil humbucking pickup.

Figure 3C:
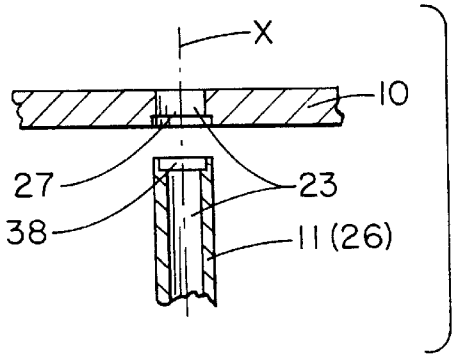
FIG. 3*c* is an enlarged view of portions of FIG. 3*b*.

The bores or channels 23 for the screw-on pole pieces 13 are stepped or countersunk as indicated at reference number 38 in FIGS. 3*c* and 5*a* in order to make it possible to embed the pole piece heads so that the differences in volume of the individual guitar stings 21 (FIG. 1*d*) can be evened out better or so that the distance a1 (FIG. 1*d*) between a terminal 13 and a string 21 can be adjusted optimally and individually.

Figure 1A:
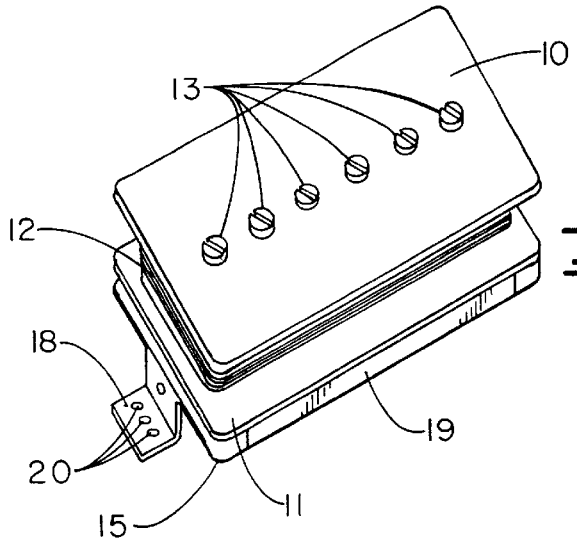
FIG. 1*a* is a perspective drawing of the preferred embodiment of a single-coil pickup of the present invention, but without an enclosing cap or frame.
Figure 1B:
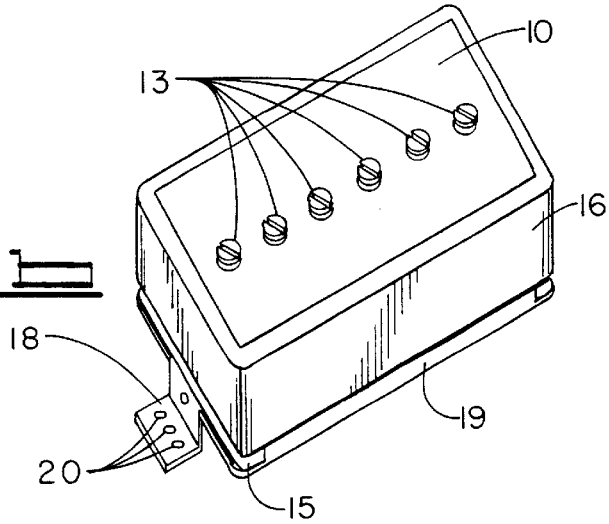
FIG. 1*b* is a perspective drawing of the pickup of FIG. 1*a*, but with a housing cap.
Figure 1C:
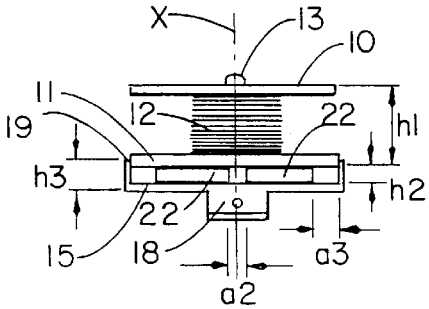
FIG. 1*c* is a side view of FIG. 1*a*.
Figure 1D:
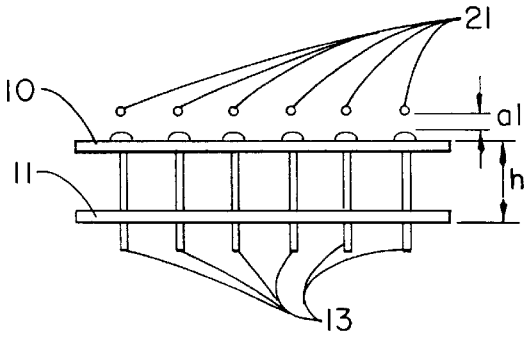
FIG. 1*d* is a schematic drawing showing pole pieces below guitar strings of an electric guitar.
Figure 2:
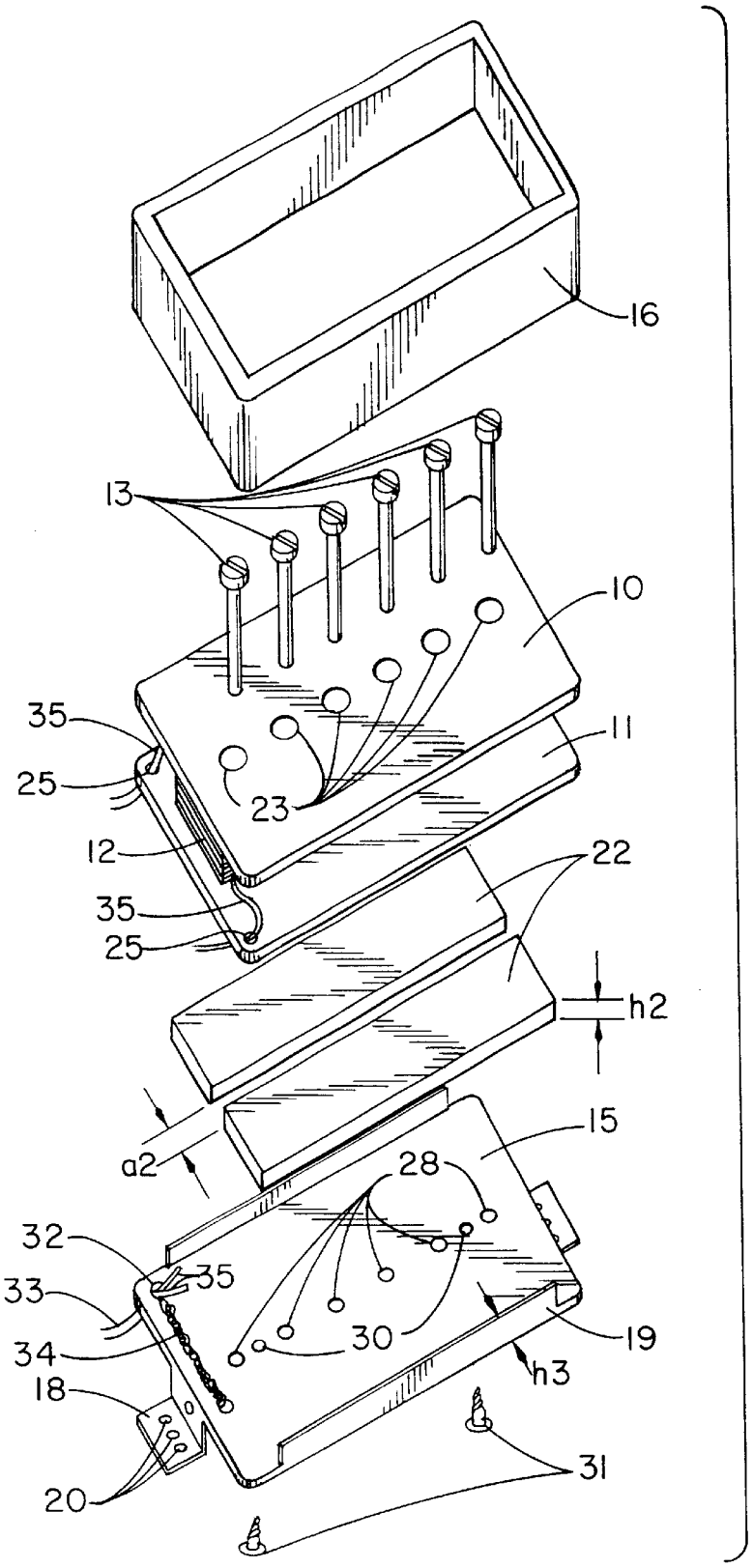
FIG. 2 is an exploded view of FIG. 1*b*.

The height h1 (FIG. 1*c*) of the coil form depends on the desired acoustic characteristic and also depends on the corresponding wire gauge of the wire of the single pickup winding or coil 12 (preferably a 42 gauge wire), the wire material (preferably enameled copper wire) and the number of turns. The parameters for a specific pickup for the neck position can be different from those for the bridge position in order to better account for the different acoustic characteristic which depends on the position. The single pickup coil 12 is wound around the ridge portion 26 of the lower coil form member 11 as shown in the drawings (FIGS. 1*a*, 1*c* and 2).

Magnets

Apart from wire gauge, wire material and number of wire turns, the material and the structure of the magnet(s) 22 are important.

Figure 10A:
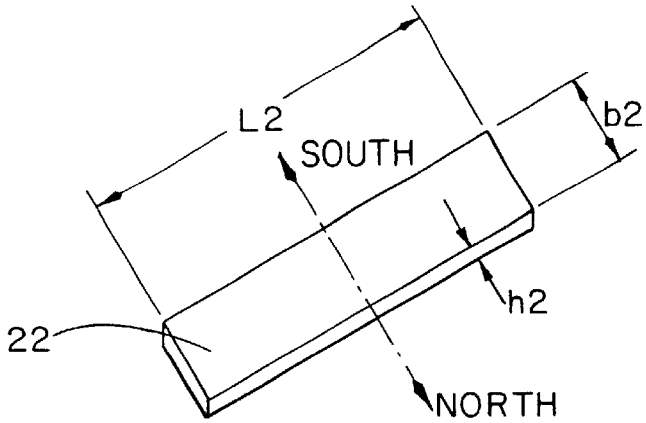
FIG. 10*a* is a perspective drawing of a rod magnet which is customarily used in the manufacture of a pickup.
Figure 10B:
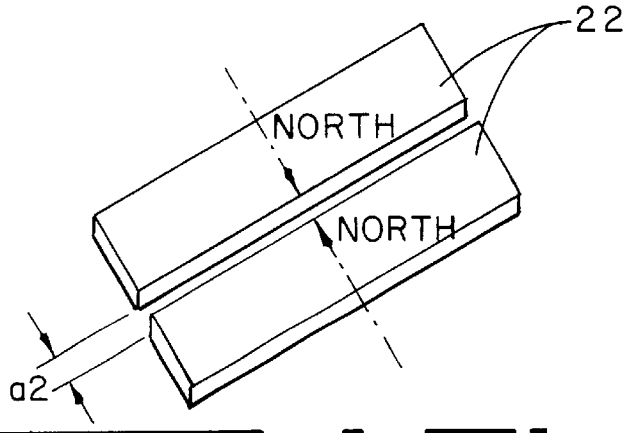
FIG. 10*b* is a perspective drawing of two magnets.

Preferred magnets 22 (FIGS. 1*c* and 2) are two opposing rod magnets with polarity as shown in FIG. 10*b*. The magnets preferably are separated only by the through screw-on pole pieces 13 by a distance a2 (FIGS. 1*a* and 10*b*). The magnets 22 preferably are comprised of an aluminum-nickel cobalt alloy; however, other magnet materials can be used as well. A pickup base plate 15 can either be completely filled in transverse direction with wide magnets—only separated by the screw-on terminals 13 as mentioned; or there can be a gap a3 (FIG. 1*c*) between the end of a magnet and a respective longitudinal side wall of the base plate, or this gap a3 can be filled with a spacer (e.g., wood, plastic, metal) (not shown). The magnetization preferably is carried out in the direction of the width b2 along the length 12 (FIG. 10*a*), but other magnetization directions are possible as well.

It is also possible to not use any rod magnets or screw-on pole piece terminals at all if bar magnets or magnet blades are used.

Base Plate

The base plate 15 (FIGS. 1, 2 and 9) preferably is comprised of metallic, non-magnetizable material with bends 19 which should be pulled along the longitudinal sides to define turned up side walls which prevent the coil form from sliding or the magnet and/or the spacers (not shown) from sliding out on these sides. The height h3 (FIGS. 1*c* and 9) of the bends 19 approximately corresponds to the thickness h2 (FIGS. 1*c* and 10*a*) of the magnet segments 22.

Figure 6:
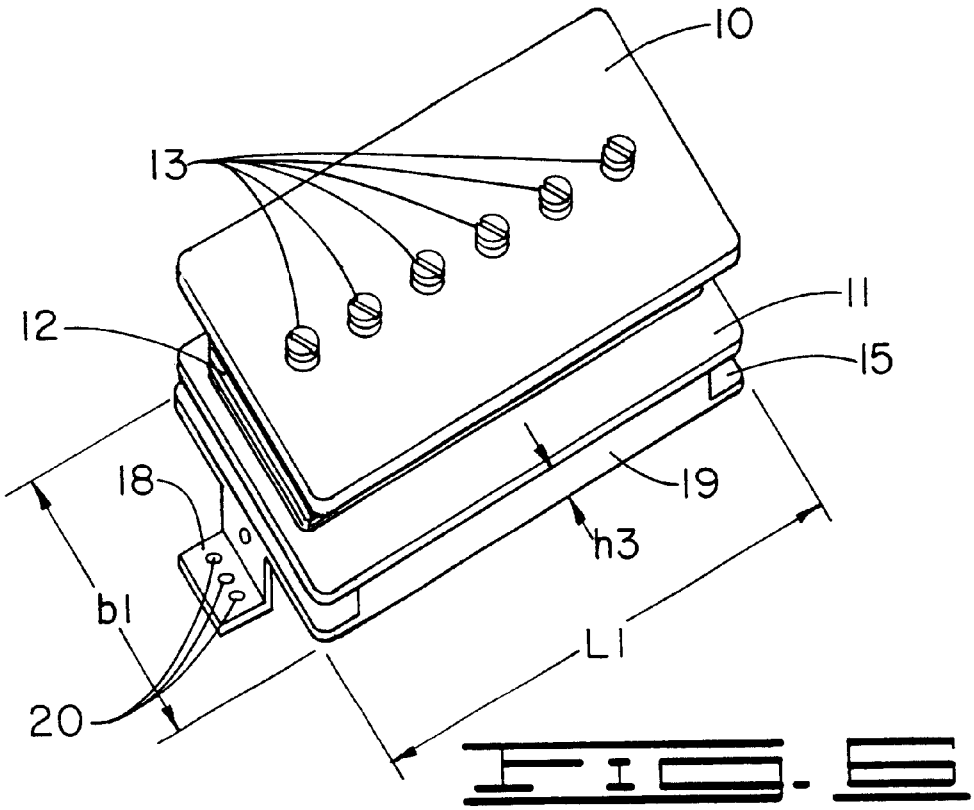
FIG. 6 is a perspective view of the preferred embodiment with the dimensions of the base of a compound coil pickup in the humbucking format.

The bottom wall of the base plate 15 corresponds approximately to, or is commensurate with, the customary dimensions of compound coil pickups in the humbucking format (see comparison of FIG. 6 and FIG. 7). Preferably, the measurements of the base are existing and standard measurements used in the industry (l1×b1 approximately 6.8/6.9 cm×3.7/3.8 cm) and make it possible to exchange the pickup with other customary pickups with a similar or identical base (e.g., P.A.F. "Humbucker™") without having to have additional or modified recesses in the surface of the resonance box or body of the instrument.

The base plate 15 preferably has six holes 28 for the ends of the screw-on pole pieces 13, preferably with threads so that the height of the pole pieces can be adjusted easily; and they preferably are arranged in longitudinal and axially symmetrical direction with identical distance a4 (FIGS. 3*a* and 9*a*) between the holes.

The distance a4 between the holes for the screw-on terminals 13 is such that the strings 21 of the instrument are centered over the screw-on terminals 13. In order to ensure that this is possible, there may be different distances a4 between the holes for the pickup designed for the neck versus the bridge positions of the pickup because the stings of guitars typically diverge more in the direction of the bridge.

Also located on the longitudinal center axis x of the pickup base plate 15 preferably are two bores or openings 30 through which two locking screws 31 (FIG. 2) are received for threadedly engaging respective bores 29 in the underside of the lower coil form member 11 (FIG. 5*b*) in order to pull the coil form in the direction of the base plate 15 by means of the two locking screws 31 and to simultaneously squeeze the magnets 22 between the base plate 15 and the lower or bottom member 11 of the coil form so that there are no self-oscillations.

Cable bushing or aperture 32 for a connection cable 33 preferably is located in a corner of the bottom wall of the base plate 15 as close as possible to the edge.

Figure 11:
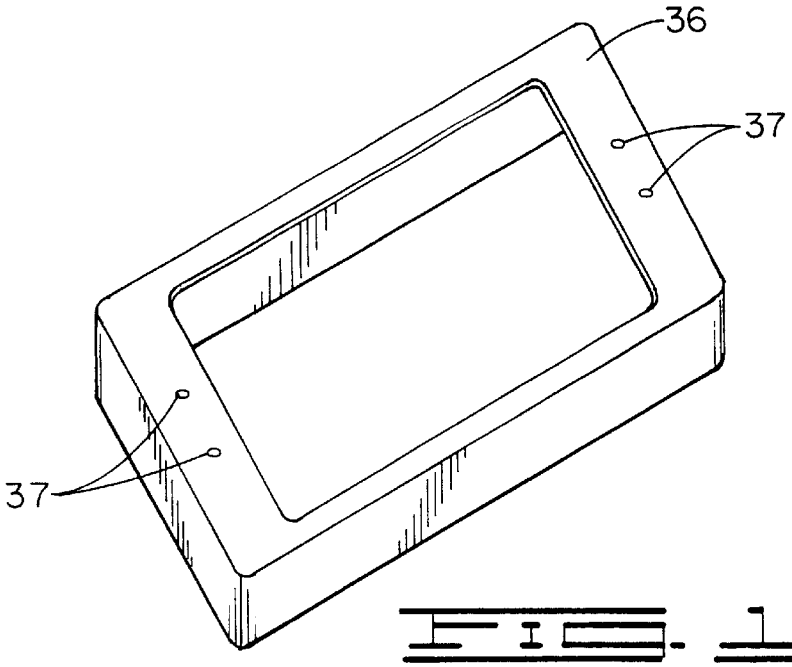
FIG. 11 is a perspective drawing of a frame with which the pickup is mounted to a guitar body.

Extending from the narrower sides of the pickup base plate 15 are L-shaped bends or flanges 18 which act as pinches in order to attach the base to a mounting frame 36 (FIG. 11) so that the height, i.e., the distance a1 to the strings 21 can be adjusted. There are one or more threaded holes 20 parallel to the face in each of these pinches 18, and preferably a plurality of such holes in order to ensure a high flexibility/ exchangeability with pickups or mounting frames of different manufacturers.

Connection Cable

Figure 9A:
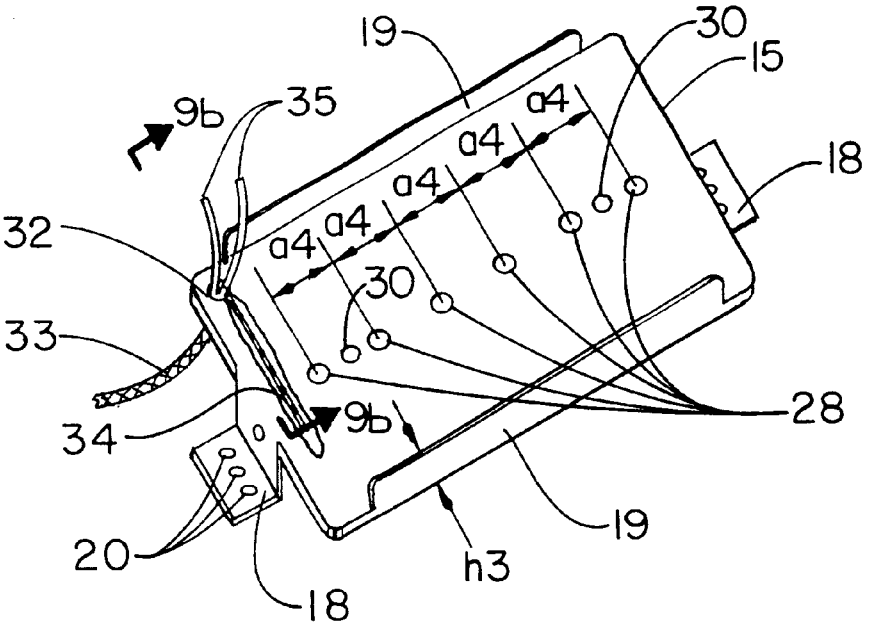
FIG. 9*a* is a perspective drawing of a pickup base plate of the preferred embodiment single-coil pickup.
Figure 9B:
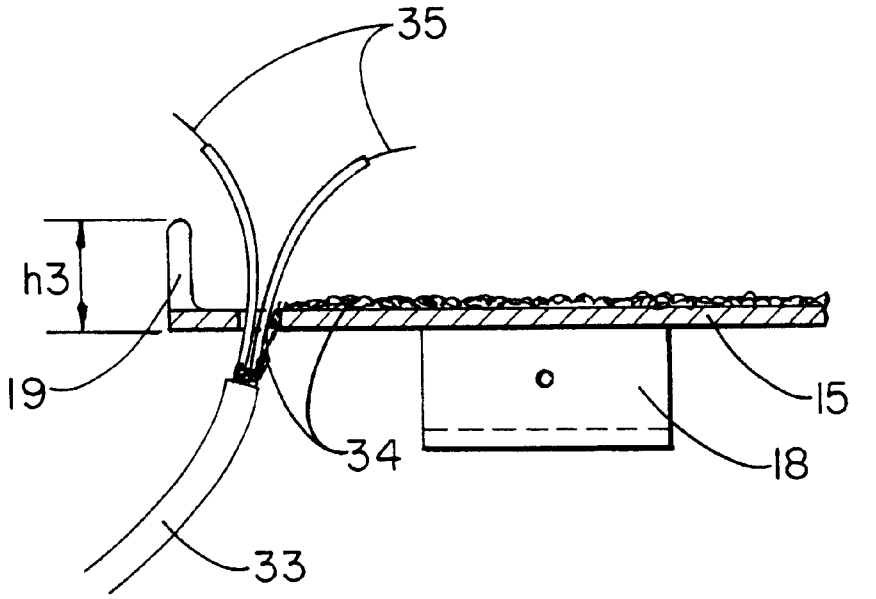
FIG. 9*b* is a partial cross-sectional view taken along line 9*b*—9*b* in FIG. 9*a*.

Referring to FIGS. 9*a* and 9*b*, the connection cable 33 preferably is a twin-wire cable with a shield braiding 34; the shield braiding 34 also serves as a pull relieve. FIG. 9*a* and FIG. 9*b* show the principle of this pull relieve with the shield braiding 34 preferably soldered onto the base plate 15. The two wire leads 35 of the cable 33 which run inside the shield braiding 34 preferably have different colors and are connected to respective ends of the winding wire of pickup coil 12 (FIG. 2) by means of a wire connection. It is possible to select the polarity of the signal voltage with regard to the mass voltage by leading both coil ends through.

Circuitry

When two pickups are used in one instrument, the structure or the circuitry is such that when both pickups are activated, external hum interference is suppressed. This happens due to the fact that a) both pickups have opposite magnetization directions b) in one pickup the coil beginning and in the other pickup the coil end are connected to ground.

By combining opposite polarity and serial circuitry it is possible to achieve maximum performance when both pickups are activated.

Pickup Frame

The pickup frame 36 preferably is attached to the body of the instrument by means of four screws (not shown). The function of the frame 36 is to retain the pickup to the instrument and to make height adjustments possible (distance a1: pickup—string) (see FIG. 1*d* and FIG. 11).

The dimensions of the frame 36 correspond to those customary in the industry. There are preferably one or two retaining holes 37 defined in each end of the face of the frame 36 in longitudinal and axially symmetrical direction (two shown at each end of FIG. 11). By using two retaining holes each the pickup is more secure in the frame than with just one hole each. In addition this permits the pickup to be tilted in longitudinal and axially symmetrical direction in order to optimally adjust the strings 21 which run over it. That is, two screws are run through the two holes 37 at one end and two screws are run through the two holes 37 at the other end (not shown). Springs are placed along the shanks of these screws, and the threaded end of each of the screws is engaged in the respective aligned hole 20 of one of the flanges 18. The springs provide tension between the mounting frame 36 and the flanges 18. Height adjustment occurs by appropriately turning the screws. Tilting adjustment occurs by turning the screws by different amounts in each pair or at one end relative to the other end.

Due to the fact that there are three threaded holes 20 each in the L-shaped pinches 18 of the base plate 15, the pickup can also be attached to other frames which are customary in the industry and which only have one retaining hole or three retaining holes.

Pickup Cap

Preferably a metal cap is used as a housing cover for mechanical protection, shield and optical enhancement. It preferably is an "open cap" 16 (FIGS. 1*b* and 2) and thus allows for the surface of the coil form upper member 10 to be almost completely visible. It is also possible to have a closed cap (with or without a recess for the screw-on terminals); see closed pickup cap 17 in FIG. 8*f*.

The combination of a single-coil pickup in the P.A.F. Humbucker format with open cap 16 and single part coil form surface 10, only interrupted by screw-on terminals 13 is the preferred optical identification of the present invention.

The hollow space between the cap 16 and the other structural components of the pickup preferably is filled with paraffin wax in order to suppress undesirable vibrations which could lead to backcouplings.

An example of a specific implementation of the foregoing is the combination of the winding of a P90 single-coil pickup on a mounting structure described above and of equal size to the structure of a P.A.F. "Humbucker™" dual-coil pickup.

The foregoing components of the present invention are made of conventional materials and in conventional ways known in the art.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A pickup for an electric guitar having a cavity sized to receive a humbucking pickup of the type having two side-by-side coil forms or windings, comprising:

a base plate to connect the pickup to the electric guitar in place of the humbucking pickup;

a lower member having a length and a width commensurate with the length and width of the humbucking pickup such that the lower member fits fully into the cavity without modifying the cavity, the lower member connected to the base plate;

an upper member having a length and width commensurate with the length and width of the humbucking pickup, the upper member connected to the lower member but spaced from a facing surface of the lower member to define a pickup winding receiving region therebetween;

only one pickup winding mounted between the lower and upper members in the pickup winding receiving region; and at least one adjustable pole piece disposed through the pickup winding and the upper and lower members.

2. A pickup as defined in claim 1, further comprising two magnets disposed adjacent the at least one pole piece.

3. The improvement of claim 2, wherein said housing includes a flange having a plurality of holes defined therein such that one of said holes aligns with a predrilled hole in a mounting frame of the guitar.

4. A pickup as defined in claim 3, further comprising a wire cable extending through the base plate and connected to the pickup winding.

5. A pickup as defined in claim 4, wherein the base plate has a length and a width commensurate with the lengths and widths of the upper and lower members and wherein the base plate has two flanges extending from opposite edges thereof.

6. A pickup as defined in claim 5, wherein the upper and lower members define an integral one-piece coil form.

7. A pickup as defined in claim 5, wherein the upper and lower members define a two-piece coil form in which one of the upper and lower members has a recess receiving the other member and in which the upper and lower members are releasably connected so that the upper member can be interchanged to present different external appearances for the pickup.

8. A pickup as defined in claim 1, wherein the base plate has a length and a width communsurate with the lengths and widths of the upper and lower members and wherein the base plate has two flanges extending from opposite edges thereof.

9. A pickup as defined in claim 1, wherein the upper and lower members define an integral one-piece coil form.

10. A pickup as defined in claim 1, wherein the upper and lower members define a two-piece coil form in which one of the upper and lower members has a recess receiving the other member and in which the upper and lower members are releasably connected so that the upper member can be interchanged to present different external appearances for the pickup.

11. A pickup for an electric guitar, comprising:

a base plate having a length and a width commensurate with the length and width of a humbucking pickup having two horizontally adjacent windings, the base plate including:

a bottom wall; and two side walls extending along opposite side edges of bottom wall;

two magnets disposed along the bottom wall of the base plate parallel to the two side walls of the base plate;

a coil form disposed on the magnets, the coil form having a length and a width commensurate with the base plate, and the coil form having a plurality of channels defined therethrough;

a plurality of threaded adjustable pole pieces, each of the pole pieces disposed in a respective one of the channels and having an end disposed between the two magnets; and a single pickup coil mounted on the coil form.

12. A pickup as defined in claim 11, further comprising a connection cable having an end extending through the bottom wall of the base plate and connected to the single pickup coil.

13. A pickup as defined in claim 12, wherein:

the coil form has two voids defined therein; and the cable includes two wires, each of the wires extending through a respective one of the voids and connected to the single pickup coil.

14. A pickup as defined in claim 12, further comprising first and second flanges, the first flange connected along one end edge of the bottom wall of the base plate and the second flange connected along an opposite end edge of the bottom wall.

15. A pickup as defined in claim 14, wherein each of the first and second flanges includes a plurality of holes for aligning with at least one pre-existing mounting hole on the guitar.

16. A pickup as defined in claim 11, wherein:

the pickup further comprises a housing cover disposed around the coil form, the housing cover including an open top cap; and the coil form includes a bottom piece and a top piece releasably connected so that the top piece can be interchanged to present different appearances through the open top cap, and further wherein the top and bottom pieces have bores therethrough defining the channels.

17. A pickup as defined in claim 16, wherein each of the bores has a countersunk entrance in the portion of the bore in the bottom piece.

18. A pickup for an electric guitar, comprising:

a housing exchangeable with a humbucking pickup connected to a pickup mounting frame on an electric guitar;

a single coil form connected to said housing, said coil form having a length and a width commensurate with the length and width of the combination of two coil forms of the humbucking pickup;

a single pickup coil mounted on said single coil form; and a plurality of adjustable pole pieces mounted in said coil form.

19. A pickup as defined in claim 18, wherein said single coil form includes a bottom piece and a top piece, said top piece having a recess receiving said bottom piece, said top and bottom pieces releasably connected so that said top piece can be interchanged to present different appearances.

20. A pickup as defined in claim 18, wherein said housing includes a base plate and a flange connected to said base plate, said flange having a plurality of holes defined therein to enable said housing to be exchanged for the humbucking pickup connected to any one of a plurality of different types of pickup mounting frame.

21. A pickup as defined in claim 18, wherein said housing includes a base plate having said single coil form mounted thereon and said base plate having a length and a width commensurate with the length and width of said single coil form.

22. A pickup as defined in claim 21, further comprising a magnet disposed between said coil form and said base plate and magnetically coupled with said pole pieces.

23. A pickup as defined in claim 22, wherein said housing further includes a mounting flange extending from said base plate.

24. A pickup as defined in claim 21, wherein said housing further includes a mounting flange extending from said base plate.

* * * * *